US007497059B2

(12) United States Patent
Bennett

(10) Patent No.: US 7,497,059 B2
(45) Date of Patent: Mar. 3, 2009

(54) MULTI-LEVEL POST TENSION CABLE SUPPORT CHAIR AND METHOD OF USE

(75) Inventor: Clifford D. Bennett, Alta Loma, CA (US)

(73) Assignee: Dayton Superior Corporation, Dayton, OH (US)

( * ) Notice: Subject to any disclaimer, the term of this patent is extended or adjusted under 35 U.S.C. 154(b) by 302 days.

(21) Appl. No.: 10/713,444

(22) Filed: Nov. 14, 2003

(65) Prior Publication Data

US 2005/0102951 A1 May 19, 2005

(51) Int. Cl.
*E04C 5/16* (2006.01)

(52) U.S. Cl. ..... 52/677; 52/649.8; 52/719; 52/687

(58) Field of Classification Search ..... 52/687, 52/677, 688, 689, 649.8, 719, 633; 404/134, 404/135, 136; 211/70.6, 184; 248/903, 500
See application file for complete search history.

(56) References Cited

U.S. PATENT DOCUMENTS

| | | | | |
|---|---|---|---|---|
| 944,731 | A | 12/1909 | Gold | |
| 1,334,545 | A | 3/1920 | Londelius, Jr. | |
| 3,106,803 | A | 10/1963 | McRobbie | |
| 3,286,419 | A | 11/1966 | Eriksson | |
| 3,289,379 | A | 12/1966 | Watts | |
| 3,387,423 | A | 6/1968 | Andersen | |
| D244,347 | S | 5/1977 | Ilukowicz | |
| D246,826 | S | 1/1978 | Ilukowicz | |
| 4,085,559 | A | 4/1978 | Ilukowicz | |
| D254,168 | S | 2/1980 | Ilukowicz | |
| 4,234,012 | A | 11/1980 | Schupback | |
| 4,644,727 | A * | 2/1987 | Hanson et al. | 52/687 |
| 4,928,472 | A | 5/1990 | Chang | |
| 5,346,063 | A * | 9/1994 | Chow | 206/376 |
| 5,505,316 | A * | 4/1996 | Lee | 211/70.6 |
| 5,595,039 | A | 1/1997 | Lowery | |
| 5,729,949 | A | 3/1998 | Hartzheim | |
| 5,765,786 | A | 6/1998 | Gretz | |
| 5,775,648 | A | 7/1998 | Metzger | |
| 5,791,095 | A | 8/1998 | Sorkin | |
| 5,819,493 | A | 10/1998 | LeMoignan | |
| 5,822,946 | A | 10/1998 | Rasmussen | |
| 6,041,947 | A * | 3/2000 | Heneveld | 211/70.6 |
| 6,082,068 | A * | 7/2000 | Fisher | 52/633 |
| 6,089,522 | A | 7/2000 | Haslem et al. | |
| 2006/0053730 | A1 * | 3/2006 | Schmutsch | 52/677 |

* cited by examiner

*Primary Examiner*—Richard E Chilcot, Jr.
*Assistant Examiner*—Jessica Laux
(74) *Attorney, Agent, or Firm*—Thompson Hine LLP

(57) ABSTRACT

A multi-level chair for supporting a concrete reinforcement cable at a fixed height from the bottom of a concrete form is provided. The multi-level chair comprises a body having a plurality of receptacles at different heights. Each of the receptacles is adapted to retain a concrete post-tension reinforcement cable. In one embodiment, the body of the chair assumes an inverted V-shape including a pair of legs extending downwardly from an apex. Each of said legs has multiple receptacles to support a cable at a predetermined height from the bottom of the concrete form.

17 Claims, 3 Drawing Sheets

MULTI-LEVEL POST TENSION CABLE SUPPORT CHAIR AND METHOD OF USE

FIELD OF THE INVENTION

The present invention pertains to supports or chairs for positioning reinforcing bars or cables used in forming concrete structures.

BACKGROUND OF THE INVENTION

Many types of concrete structures, such as concrete slabs or floors, include reinforcement bars which are used to increase the strength and integrity of the concrete structure. The reinforcement bars are typically arranged in rows or grids within a form into which concrete is poured and allowed to cure or harden. Spacers or chairs are conventionally used to support and hold in position the reinforcement bars a desired distance above the bottom of the concrete form. The spacers or chairs allow the reinforcement bars to be fully encased by the concrete and positioned at a predetermined depth within the concrete structure.

Conventional chairs or spacers are constructed at several different standard heights because reinforcement bars are frequently spaced at different heights according to the type of structure to be formed. One drawback to using rigid chairs of a predetermined height is that if one or more reinforcement bars are to be supported at different heights multiple different chairs must be used. This requires a contractor to predetermine how many chairs of a particular height are necessary and bring the necessary number of chairs of that particular height to the site where the concrete will be formed. Different numbers of chairs of different heights must be brought to the job site. The contractor may miscalculate the number of chairs of select heights, thereby causing unnecessary delay and expense. Additionally, if too many chairs are erroneously brought to the job site, excess chairs must be removed from the job site once the job is completed, again causing unnecessary time and expense.

One type of reinforcement bar used in horizontally oriented concrete structures or slabs is called a post-tension cable. Post-tension cables are used to put concrete structures in compression. Post-tension cables are held in a drooped or arched shaped with chairs of different heights. The ends of the post-tension cable are held up by the concrete form prior to the pouring of the concrete. Once the concrete has been poured and allowed to harden or cure in the form, the ends of the post-tension cable are pulled in opposite directions, so the post-tension cable is placed in tension. The tension placed on the post-tension cable thereby puts the concrete section in compression. The location of the post-tension cable in a drooping orientation in the cured concrete creates a lifting force on the center of the concrete section or span once the post-tension cable is put in tension.

In order to hold the post-tension cable in a drooping orientation before the concrete is poured and allowed to harden, multiple support chairs of varying heights are required to be placed underneath the post-tension cable at predetermined locations along the length of the post-tension cable. This requires the contractor or builder to predetermine which support chairs to purchase for each job and how many of each type to order from the distributor. The distributor must then correctly count out and transport the correct number of each desired chair to the job site. Placement personnel must then place the correct support chair in the correct location before the concrete is poured. Each step in this process is subject to human or computer error. Each error may require additional time and money to correct, thus adding additional costs to the job and potentially delaying the pouring of the concrete.

There is thus a need for a support chair which is able to support a predetermined gauge of reinforcement cable at multiple heights. A contractor could then order multiple support chairs based only on the gauge of reinforcement cable being used without having to worry about how many chairs of a predetermined height are required for a particular job. The distributor would not need to count out and package the support chairs by height. Lastly, placement personnel would be able to pick up and place the support chairs in a predetermined location before placing the post-tension cable in an appropriate receptacle or slot at the appropriate height.

SUMMARY OF THE INVENTION

The present invention provides a multi-level chair for supporting a post-tension concrete reinforcement cable at a fixed height from a bottom of a concrete form. The multi-level chair has a body including a plurality of receptacles at different heights from the bottom of the concrete form. All of the receptacles are identically sized to receive and retain the same diameter of post-tension concrete reinforcement cable.

The body is preferably injection molded plastic but may be made of any material including, but not limited to metal. In one exemplary embodiment of the present invention, the body has an inverted V-shape including a pair of legs extending downwardly from an apex. In this embodiment, the receptacles are located along the lengths of the legs at staggered heights from the bottom of body which resides on the concrete form. Each of the legs terminate in a foot which is adapted to rest on the bottom of the concrete form.

In use, a contractor is able to order a plurality of the same multi-level chair without having to worry about how many of each size to order from a distributor. At the job site, placement personnel may place the same multi-level chair at desired locations. The placement personnel may then support each post-tension concrete reinforcement cable in an arched orientation above the bottom of a concrete form with a plurality of the same multi-level chairs.

The method of supporting a post-tension concrete reinforcement cable in an arched orientation above the bottom of a concrete form in accordance with the present invention comprises providing a plurality of identical multi-level chairs, each of said chairs having a body having multiple receptacles for supporting the post-tension concrete reinforcement cable. Each of the multi-level chairs is placed at spaced locations along the length of the post-tension concrete reinforcement cable. Lastly, the post-tension concrete reinforcement cable is placed in one of the receptacles of each of the multi-level chairs such that the post-tension concrete reinforcement cable is supported a predetermined height from the bottom of the concrete form in an arched orientation. Using the present invention, only one type of chair is required rather than multiple different chairs, thereby reducing the cost of the job.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
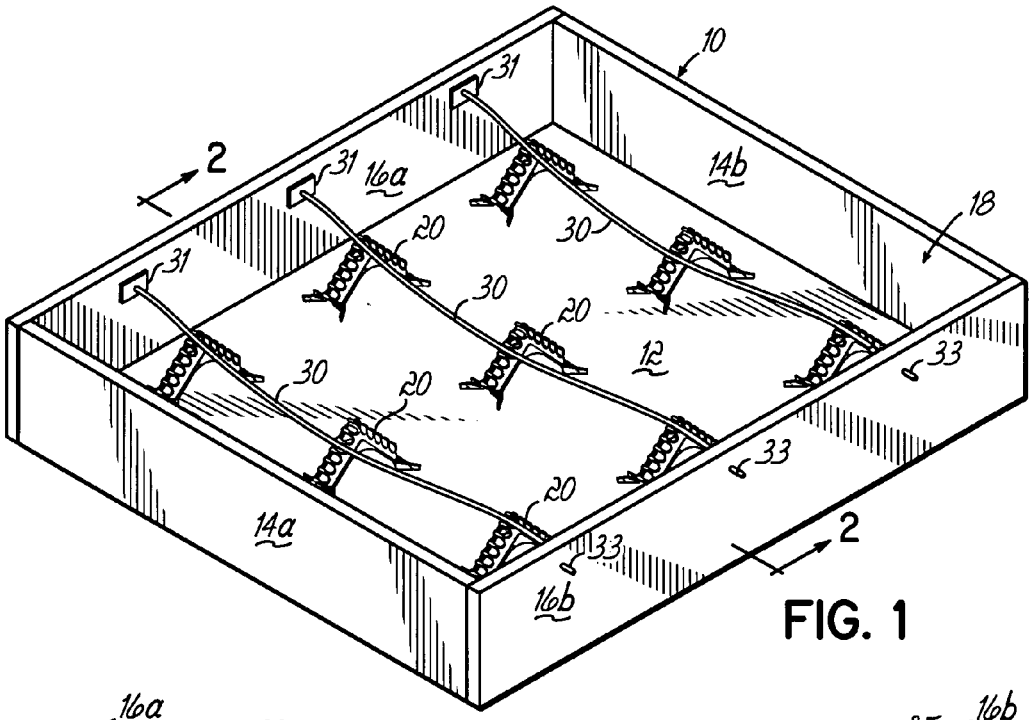
FIG. 1 is perspective view of a simplified concrete form, the multi-level chairs of the present invention supporting a plurality of post-tension concrete reinforcement cables in an arched orientation above the bottom of the concrete form.
Figure 2:
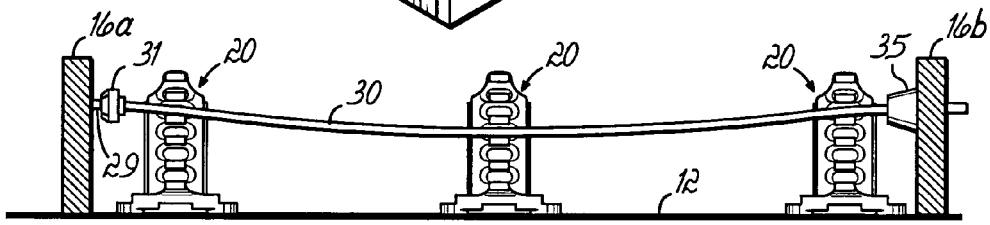
FIG. 2 is a cross-sectional view taken along the line 2-2 of FIG. 1.

Referring to FIGS. 1 and 2, there is shown a simplified concrete form 10 comprising a bottom 12, a pair of sidewalls 14*a*, 14*b* and a pair of end walls 16*a*, 16*b* extending upwardly from the periphery of the bottom 12, as is conventional in the formation of concrete forms. The bottom 12, sidewalls 14*a*, 14*b* and end walls 16*a*, 16*b* define an interior 18 of the concrete form 10. The bottom 12 is preferably planar and may be made of sand, wood or any suitable material. Although illustrated in one particular configuration, the concrete form 10 may assume any shape or configuration without departing from the spirit of the invention of this application. Positioned within the form 10 are multi-level chairs 20 supporting post tensioning cables 30. For purposes of illustration only, three post tensioning cables 30 are shown, each supported by three chairs 20, but it will be appreciated that in practice the number of cables and chairs in a typical installation will be in the hundreds or thousands.

Figure 3:
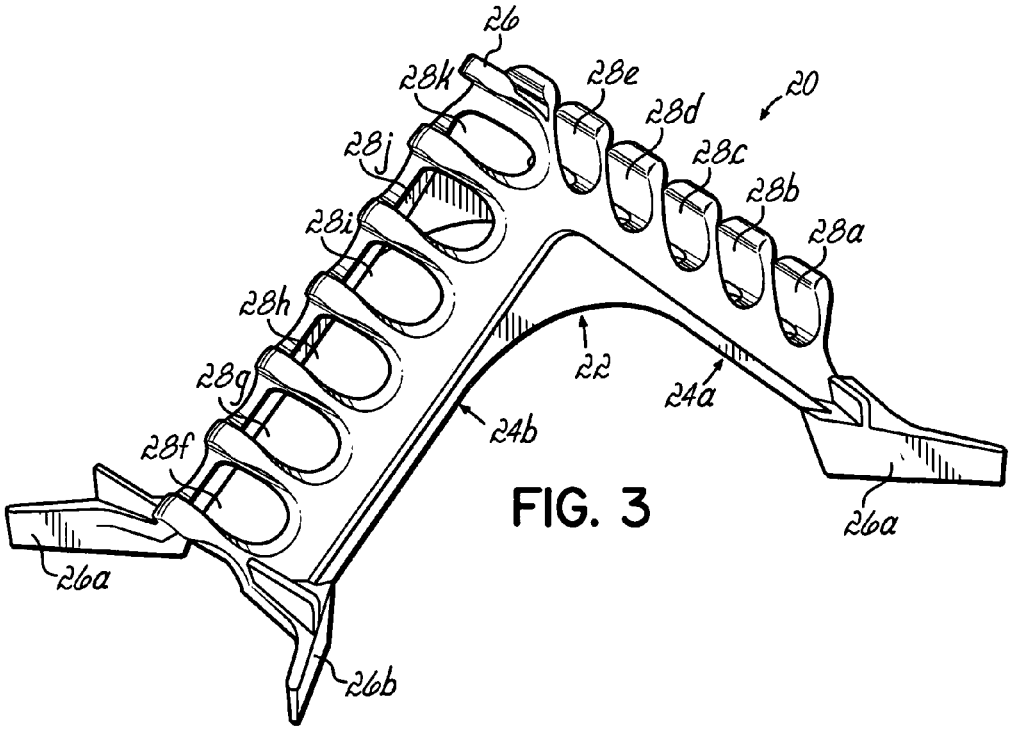
FIG. 3 is a perspective view of a preferred embodiment of the multi-level chair shown in FIG. 1.

Referring now to FIG. 3, a preferred embodiment of the multi-level chair 20 of the present invention is illustrated. In this preferred embodiment of multi-level chair 20, the chair 20 has a body 22 which assumes an inverted V-shape including a pair of legs 24*a*, 24*b* which extend downwardly from an apex 26. The body 22 is preferably a unitary member made of injection molded plastic; however, it may be made of any material. Each the legs 24*a*, 24*b* has a generally V-shaped cross-sectional configuration in the drawings. However, this cross-sectional configuration of the body 22 may assume any of numerous designs without departing from the spirit of the invention of this application. Leg 24*a* terminates at its lower end in a pair of spaced feet 26*a* (only one being shown in FIG. 3). Similarly leg 24*b* terminates at its lower end in a pair of spaced feet 26*b*. The four feet, 26*a*, 26*b* are adapted to rest on the bottom 12 of the concrete form 10 in the manner shown in FIGS. 1 and 2. Other forms or configurations of feet not illustrated may alternatively be used to anchor the multi-level chair 20 in accordance with the present invention.

The leg 24*a* of the body 22 has a plurality of receptacles 28*a*-28*e* inherently built therein at different, spaced heights from the bottom 12 of the concrete form 10 when the multi-level chair 20 is placed on the bottom 12 of the concrete form 10. Similarly, the leg 24*b* of the body 22 has a plurality of receptacles 28*f*-28*k* inherently built therein at different heights from the bottom 12 of the concrete form 10 when the multi-level chair 20 is placed on the bottom 12 of the concrete form 10. The receptacles 28*a*-28*k* are each located at a different height from the bottom 12 of the concrete form 10 when the multi-level chair 20 is placed on the bottom 12 of the concrete form 10. More specifically, the receptacles 28*a*-28*e* of the multi-level chair 20 are at staggered heights relative to the receptacles 28*f*-28*k* . For example, when the multi-level chair 20 is placed on the bottom 12 of the concrete form 10 receptacle 28*a* is 0.75 inches above bottom 12 of the concrete form 10; receptacle 28*f* is 1.00 inches above the bottom 12 of the concrete form 10; receptacle 28*b* is 1.25 inches above the bottom 12 of the concrete form 10; receptacle 28*g* is 1.25 inches above the bottom 12 of the concrete form 10, etc. Therefore, none of the receptacles are at identical heights when the multi-level chair 20 is placed on the bottom 12 of the concrete form 10. The receptacles 28*a*-28*k* are spaced a fixed distance from each other; 0.25 inches in the example described above. Although, in the example described the receptacles are spaced from each other 0.25 inches, this distance may be any desired distance. Although five receptacles 28*a*-28*e* are illustrated and described built into the leg 24*a* and six receptacles 28*f*-28*k* are illustrated and described built into the leg 24*b*, a lesser or greater number of receptacles may be formed in either leg without departing from the spirit of the invention of this application.

The receptacles 28*a*-28*k* are all identically sized to receive and retain a predetermined gauge of reinforcement cable. Once a contractor knows the size or gauge of post-tension reinforcement cable he or she is going to use in a particular concrete form, the contractor is able to order the appropriate number of multi-level chairs 20 having the appropriate size of receptacles. Different multi-level chairs 20 have different receptacle sizes so that a contractor will order the multi-level chairs based on the size of receptacle, as opposed to the height of the chair. Typical sizes range from #3 gauge post-tension reinforcement cable (0.375 inches in diameter) to #12 gauge post-tension reinforcement cable (1.25 inches in diameter).

Referring now to FIGS. 1 and 2, there is illustrated a plurality of post-tension reinforcement cables 30 supported above the bottom 12 of the concrete form 10 with the multi-level chairs 20 of the present invention. As best illustrated in FIG. 2, each post-tension reinforcement cable 30 is maintained in a drooped or arched orientation by supporting and retaining the post-tension cable 30 in different receptacles of the multi-level chairs of the present invention.

As best illustrated in FIGS. 1 and 2, a fixed end 29 of the post-tension reinforcement cable 30 is secured in an anchor 31 which is secured to one of the concrete form boards 16*a* in a manner known in the art. The other or free end 33 of the post-tension reinforcement cable 30 is passed through a plastic void former 35 (see FIG. 2) and through the opposite concrete form board 16*b* in a manner known in the art. Once the concrete has hardened and the form boards 16*a*, 16*b* are removed, the post-tension reinforcement cable 30 is pulled into tension using wedges or any other method known in the art. Any other method or device known in the industry may alternatively be used to secure the ends of the post-tension reinforcement cable 30 and pull the post-tension reinforcement cable 30 in tension after the concrete has hardened.

In use, the multi-level chairs 20 of the present invention are placed at predetermined locations on the bottom or floor 12 of the concrete form 10. A post-tension reinforcement cable 30 is then placed in one of the receptacles of each of the multi-level chairs 20 such that the post-tension reinforcement cable 30 is supported above the bottom 12 of the concrete form 10 in a drooped or arcuate orientation as shown in FIGS. 1 and 2.

Figure 4:
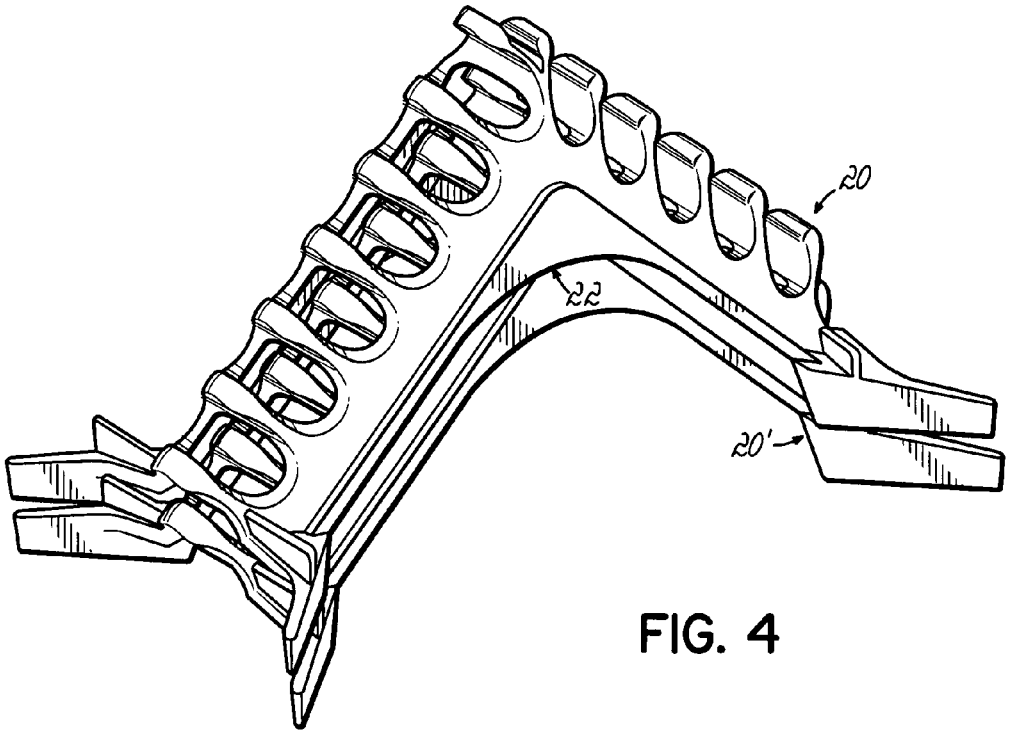
FIG. 4 is a perspective view of two of the multi-level chairs shown in FIG. 3 in a nested, stacked relation.

FIG. 4 illustrates the multi-level chair 20 of FIG. 3 stacked on top of another multi-level chair 20'. Because the body 22 of the multi-level chair 20 is nestably stackable, multiple multi-level chairs may be nestably, stacked one on top of another, thereby saving space during shipment and transport in general. The nestably stackable multi-level chair 20 of the present invention enables a contractor or laborer to carry more multi-level chairs more efficiently to and from a job site than has heretofore been possible.

Figure 5:
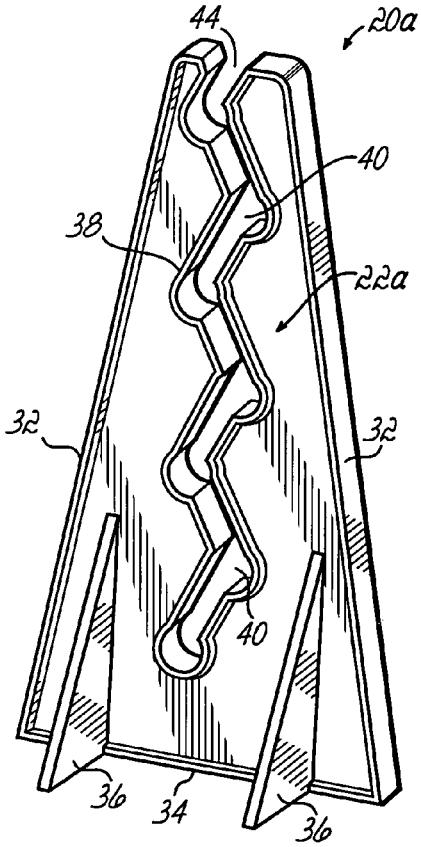
FIG. 5 is a perspective view of an alternative preferred embodiment of the multi-level chair of the present invention.

Referring now to FIG. 5, an alternative preferred embodiment of the multi-level chair 20*a* of the present invention is illustrated. In this preferred embodiment of multi-level chair 20*a*, the chair 20*a* has a body 22*a* which assumes a generally triangular shape including a pair of sidewalls 32 which extend upwardly from a base 34 and terminate in a top wall 35. A plurality of supports 36 hold the body 22*a* in an upright orientation. Although one configuration of support 36 is illustrated, the body 22 of the multi-level chair 20*a* may be supported by any other suitable support or supports. The body 22*a* is preferably a unitary member made of injection molded plastic; however, it may be made of any material.

Extending downwardly in a zig-zag manner is a slot 38 having a plurality of receptacles 40 between which are located linear segments 42. At the top of the slot 38 is an opening 44. The receptacles 40 are each located at a different height from the bottom 12 of the concrete form 10 when the multi-level chair 20*a* is placed on the bottom 12 of the concrete form 10.

The receptacles 40 are all identically sized to receive and retain a predetermined gauge of reinforcement cable. Once a contractor knows the size or gauge of post-tension reinforcement cable he or she is going to use in a particular concrete form, the contractor is able to order the appropriate number of multi-level chairs 20*a* having the appropriate size of receptacles. Different multi-level chairs 20*a* have different receptacle sizes so that a contractor will order the multi-level chairs based on the size of receptacle, as opposed to the height of the chair.

Figure 6:
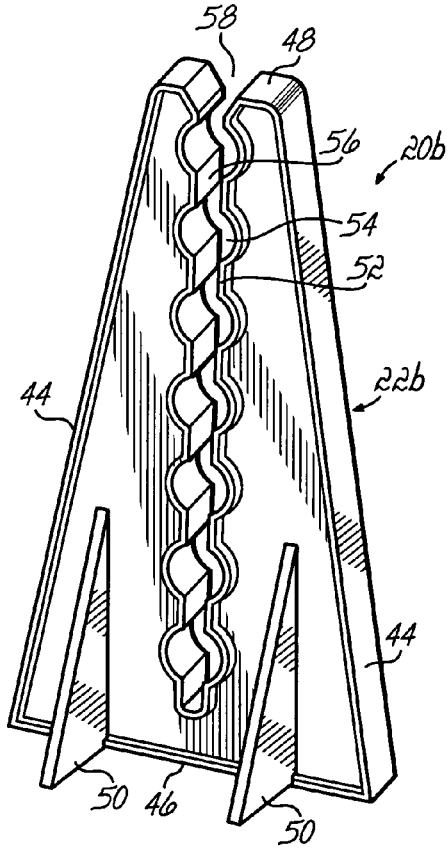
FIG. 6 is a perspective view of another alternative preferred embodiment of the multi-level chair of the present invention.

Referring now to FIG. 6, another alternative preferred embodiment of the multi-level chair of the present invention is illustrated. In this preferred embodiment of multi-level chair 20*b*, the chair 20*b* has a body 22*b* which assumes a generally triangular shape including a pair of sidewalls 44 which extend upwardly from a base 46 and terminate in a top wall 48. A plurality of supports 50 hold the body 22*b* in an upright orientation. Although one configuration of support 50 is illustrated, the body 22*b* of the multi-level chair 20*b* may be supported by any other suitable support or supports. The body 22*b* is preferably a unitary member made of injection molded plastic; however, it may be made of any material.

Extending downwardly in a linear manner is a slot 52 having a plurality of receptacles 54 between which are located linear segments 56. At the top of the slot 52 is an opening 58. The receptacles 54 are each located at a different height from the bottom 12 of the concrete form 10 when the multi-level chair 20*b* is placed on the bottom 12 of the concrete form 10.

Again, the receptacles 54 are all identically sized to receive and retain a predetermined gauge of reinforcement cable. Once a contractor knows the size or gauge of post-tension reinforcement cable he or she is going to use in a particular concrete form, the contractor is able to order the appropriate number of multi-level chairs 20*b* having the appropriate size of receptacles. Different multi-level chairs 20*b* have different receptacle sizes so that a contractor will order the multi-level chairs based on the size of receptacle, as opposed to the height of the chair.

Figure 7:
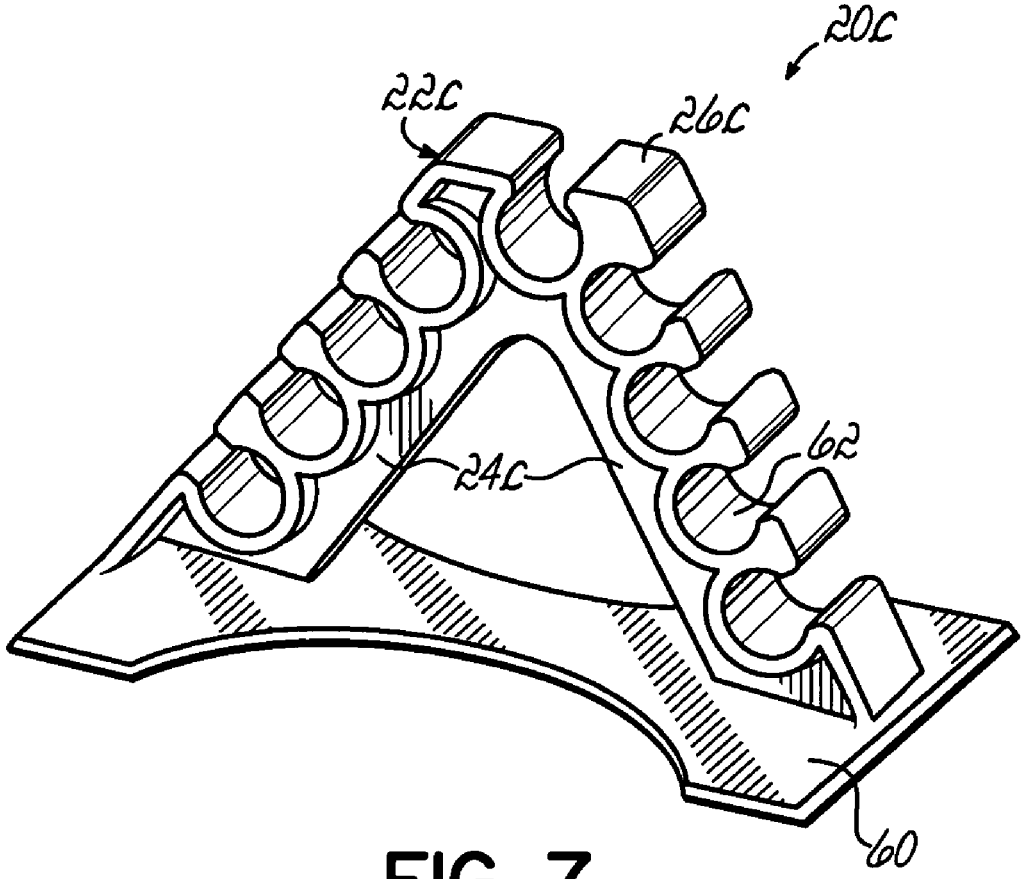
FIG. 7 is a perspective view of yet another alternative preferred embodiment of the multi-level chair of the present invention.

Referring now to FIG. 7, another preferred embodiment of the multi-level chair of the present invention is illustrated. In this preferred embodiment of multi-level chair 20*c*, the chair 20*c* has a body 22*c* which assumes an inverted V-shape including a pair of legs 24*c* which extend downwardly from an apex 26*c*. The body 22*c* is preferably a unitary member made of injection molded plastic; however, it may be made of any material. The base plate 60 is adapted to rest on the bottom 12 of the concrete form 10 in the manner shown in FIGS. 1 and 2. Other forms or configurations of base plate not illustrated may alternatively be used to anchor the multi-level chair 20*c* in accordance with the present invention.

Each leg 24*c* of the body 22*c* has a plurality of receptacles 62 inherently built therein at different, spaced heights from the bottom 12 of the concrete form 10 when the multi-level chair 20*c* is placed on the bottom 12 of the concrete form 10. Again, the receptacles 62 are each located at a different height from the bottom 12 of the concrete form 10 when the multi-level chair 20*c* is placed on the bottom 12 of the concrete form 10. the bottom 12 of the concrete form 10, etc. Therefore, none of the receptacles are at identical heights when the multi-level chair 20 is placed on the bottom 12 of the concrete form 10. The receptacles 62 are preferably spaced a fixed distance from each other. Although four receptacles 62 are illustrated and described built into each leg 24*c*, a lesser or greater number of receptacles may be formed in either leg without departing from the spirit of the invention of this application.

The receptacles 62 are all identically sized to receive and retain a predetermined gauge of reinforcement cable. Once a contractor knows the size or gauge of post-tension reinforcement cable he or she is going to use in a particular concrete form, the contractor is able to order the appropriate number of multi-level chairs 20*c* having the appropriate size of receptacles. Different multi-level chairs 20*c* have different receptacle sizes so that a contractor will order the multi-level chairs based on the size of receptacle, as opposed to the height of the chair.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A multi-level chair for supporting a post-tension concrete reinforcement cable at a fixed height from a bottom of a concrete form, said multi-level chair comprising:

a body including a plurality of receptacles adapted to receive post-tension reinforcement cable and a bottom adapted to rest on the bottom of the concrete form, the plurality of receptacles comprising at least three receptacles positioned at different heights from the bottom of the chair, the different heights being equally spaced apart heights, with each of said receptacles substantially defining an unobstructed channel sized for post-tension reinforcement cable of a predetermined diameter, and each of said channels extending parallel to the bottom of the chair and across the entire body of the chair.

2. The multi-level chair of claim 1 wherein said body has an inverted V-shape including a pair of legs extending downwardly from an apex of said body.

3. The multi-level chair of claim 2 wherein said receptacles are at staggered heights along said legs.

4. The multi-level chair of claim 2 wherein said chair is nestably stackable.

5. The multi-level chair of claim 4 wherein said legs have a generally V-shaped cross-sectional configuration.

6. The multi-level chair of claim 2 wherein the bottom of the chair comprises a pair of spaced feet provided at the downward ends of each of said legs.

7. The multi-level chair of claim 2 wherein the bottom of the chair comprises a base plate extending between the downward ends of said legs.

8. A multi-level chair for supporting a post-tension concrete reinforcement cable at a fixed height from a bottom of a concrete form, said multi-level chair comprising:

an inverted V-shaped body having a pair of legs extending downwardly from an apex of said body, said body including multiple receptacles adapted to receive post-tension reinforcement cable, said multiple receptacles comprising at least three receptacles positioned at different heights from a base of said body along at least one of said legs, the different heights being equally spaced apart heights, with each of said receptacles substantially defining an unobstructed channel sized for post-tension reinforcement cable of a predetermined diameter, and each of said channels extending parallel to the base of the chair and across the entire body of the chair, and each of said receptacles being oriented perpendicularly to the plane defined by said V-shape, wherein a user may place said post-tension cable in a selected one of said receptacles.

9. The multi-level chair of claim 8 wherein said receptacles are vertically spaced apart from each other one-quarter inch.

10. The multi-level chair of claim 8 wherein said receptacles are adapted to receive the same gauge cable.

11. The multi-level chair of claim 8 wherein said chair may be nestably stacked on top of a second multi-level chair.

12. A multi-level chair for supporting a concrete reinforcement cable under tension at a fixed height from a bottom of a concrete form, said multi-level chair comprising:

an inverted V-shaped body having a pair of legs extending downwardly from an apex of said body, each of said legs having a fixed length and multiple receptacles adapted to receive post-tension reinforcement cable, said multiple receptacles comprising at least two receptacles positioned at different heights from a base of said body along said length of said leg, wherein said multiple receptacles of one of said legs are positioned at different heights with respect to said multiple receptacles of the other of said legs, wherein said multiple receptacles are oriented perpendicularly to the plane defined by said V-shape, with each of said receptacles substantially defining an unobstructed channel sized for post-tension reinforcement cable of a predetermined diameter, and each of said channels extending parallel to the base of the chair and across the entire body of the chair, and wherein a user may support said reinforcement cable in each receptacle.

13. The multi-level chair of claim 12 wherein each of said legs terminates in a foot.

14. The multi-level chair of claim 13 wherein said feet are joined by a base plate.

15. The multi-level chair of claim 12 wherein said receptacles are spaced from each other one-half inch along each of said legs.

16. The multi-level chair of claim 12 wherein said receptacles are adapted to receive the same gauge cable.

17. The multi-level chair of claim 11 wherein said legs have a generally V-shaped cross-sectional configuration.

* * * * *